US005210883A

United States Patent [19]

Weber et al.

[11] Patent Number: 5,210,883

[45] Date of Patent: May 18, 1993

[54] INSTALLATION BLOCK FOR A SANITARY DEVICE

[75] Inventors: Peter Weber; René Dolder, both of Jona, Switzerland

[73] Assignee: Geberit AG, Jona, Switzerland

[21] Appl. No.: 711,912

[22] Filed: Jun. 7, 1991

[30] Foreign Application Priority Data

Jun. 8, 1990 [CH] Switzerland ..... 1935/90

[51] Int. Cl.[5] ..... E03D 11/00

[52] U.S. Cl. ..... 4/252.2; 4/419; 4/353

[58] Field of Search ..... 4/252.1, 252.2, 353, 4/416, 419, DIG. 7, DIG. 18

[56] References Cited

U.S. PATENT DOCUMENTS 2,769,981 11/1956 Jaye .
5,090,064 2/1992 Breitenberger .

FOREIGN PATENT DOCUMENTS 0060978 9/1982 European Pat. Off. .
0324169 7/1989 European Pat. Off. .
3309460 9/1984 Fed. Rep. of Germany .
2228905 12/1974 France .

*Primary Examiner*—William A. Cuchlinski, Jr.
*Assistant Examiner*—W. Morris Worth
*Attorney, Agent, or Firm*—McGlew and Tuttle

[57] ABSTRACT

The installation block has a support frame 1 assembled from longitudinal and transverse sections (3, 2) as well as a molding (22) foamed into this frame. Connections (5, 18, 19) for fastening a sanitary device (6), as well as for fastening the installation block on a building wall are arranged on the support frame (1). The elements needed for supplying and discharging from the sanitary device are embedded in the molding (22) made from expanded polystyrene foam. In addition, the molding (22) holds the sections (3, 2) together, and forms a condensation water insulation for a flush tank 4 embedded in the foam.

5 Claims, 2 Drawing Sheets

INSTALLATION BLOCK FOR A SANITARY DEVICE

FIELD OF THE INVENTION

The present invention pertains in general to an installation block for the mounting of a sanitary device such as a toilet bowl. In particular, the invention relates to an installation block holding the many elements of a sanitary device together and supporting the sanitary device.

BACKGROUND OF THE INVENTION

A prior-art installation block of this type has a foamed molding made of polystyrene aeroconcrete. Pipes, fittings, built-in parts, and fastening means for, e.g., a wall-mounted sanitary device are embedded in foam in the molding of this installation block. Thus, these parts are accurately preinstalled, which eliminates expensive operations at the site of installation. Since high support forces are transmitted to the molding of the installation block and passed on, e.g., in the case of a wall-mounted toilet, the following difficulties arise here.

Polyester aeroconcrete is able to absorb these strong support forces but it has a relatively high specific gravity, and the raw materials needed to produce it are relatively expensive.

During production, the fastening means to be embedded in foam during the preparation, with the auxiliary structures, must be positioned very accurately, which is expensive.

Different blocks require corresponding different auxiliary structures.

SUMMARY AND OBJECTS OF THE INVENTION

It is an object of the present invention to provide an installation block of the above-described type, which avoids the above-mentioned difficulties. The installation block shall also be self-supporting as a toilet installation block, but nevertheless it shall be able to be produced at a low cost. The task is accomplished according to the present invention by using a support frame surrounding the elements of the sanitary device and filling the areas between the support frame and the elements with an expanded polystyrene molding. In the installation block according to the present invention, the means for fastening the installation device are arranged on the support frame. The molding foamed into the support frame has practically no support function and serves here essentially only to hold together the individual parts, which it connects to the support frame. The molding is made of expanded polystyrene, and is therefore substantially lighter at equal volume, and has a substantially higher thermal insulating effect. It was found that the thermal insulation of the installation block according to the present invention is so high that an embedded flush tank no longer needs the previously necessary insulation around the flush tank to prevent condensation. Additional condensation prevention insulation is consequently not required in the installation block according to the present invention.

Since, as was mentioned, the necessary fastening means are arranged directly on the support frame, corresponding positioning measures during foaming are eliminated.

According to a variant of the present invention, one surface zone of the molding is designed to be harder than deeper zones of this molding. This harder surface of the molding leads to better compression strength properties and permits reliable covering, along with a correspondingly lower overall weight of the molding. The thermal insulation is increased correspondingly due to the lower density inside the molding.

According to a variant of the present invention, the support frame is composed of longitudinal and transverse sections.

Further advantageous characteristics will become apparent from the claims, as well as the following description.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
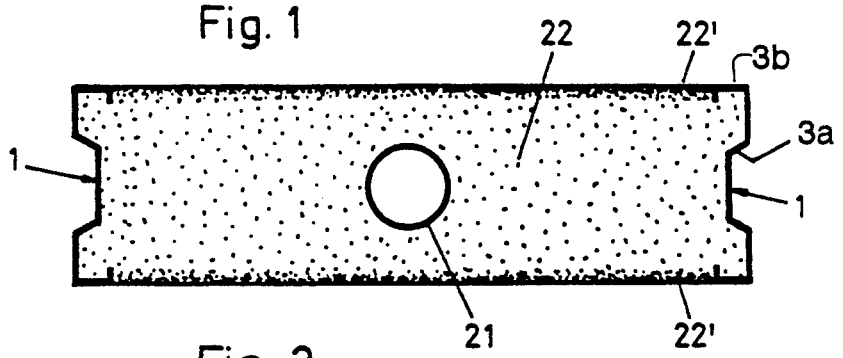
FIG. 1 is a section through an installation block according to the present invention along line I—I in FIG. 2.
Figure 2:
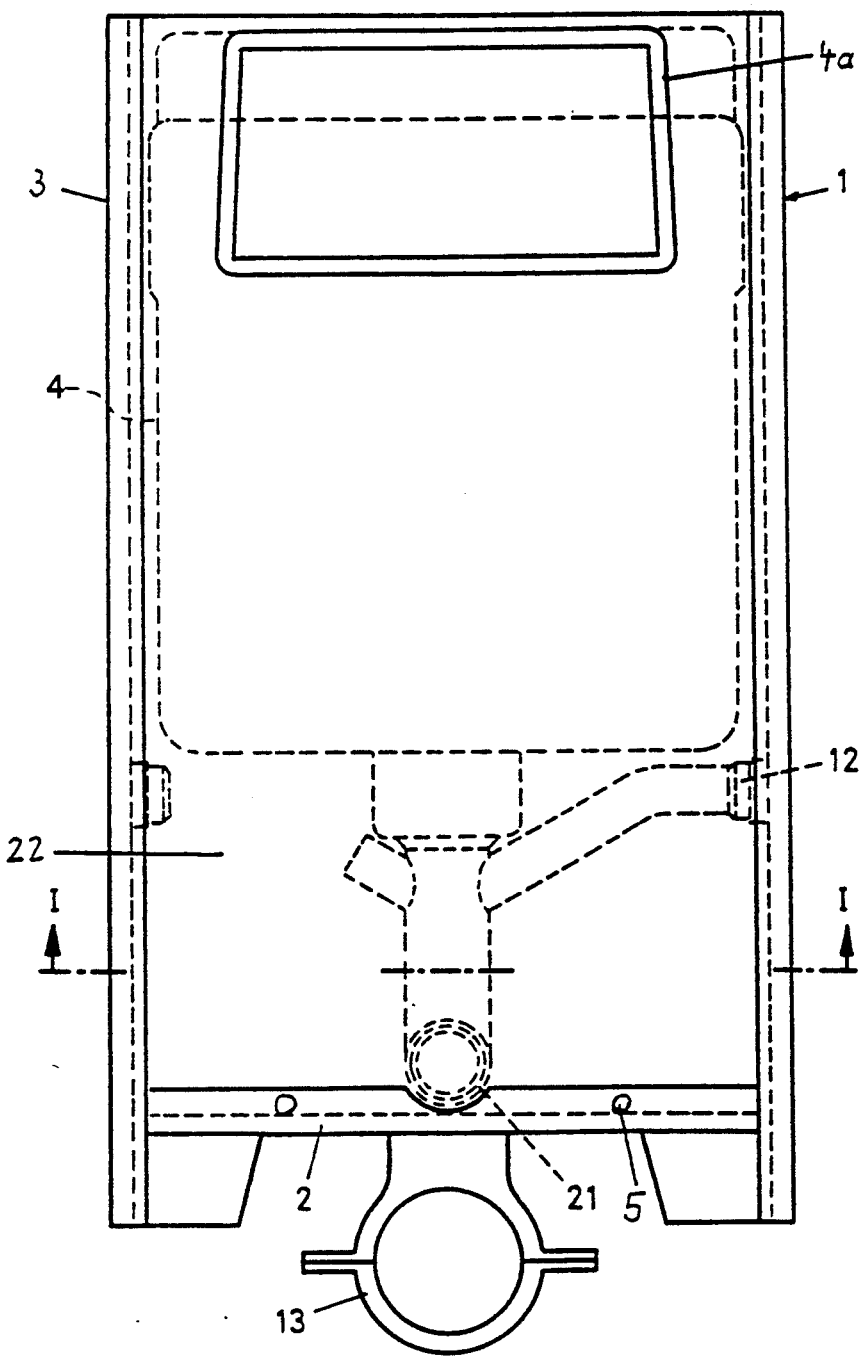
FIG. 2 is a front view of an installation block according to the present invention.
Figure 3:
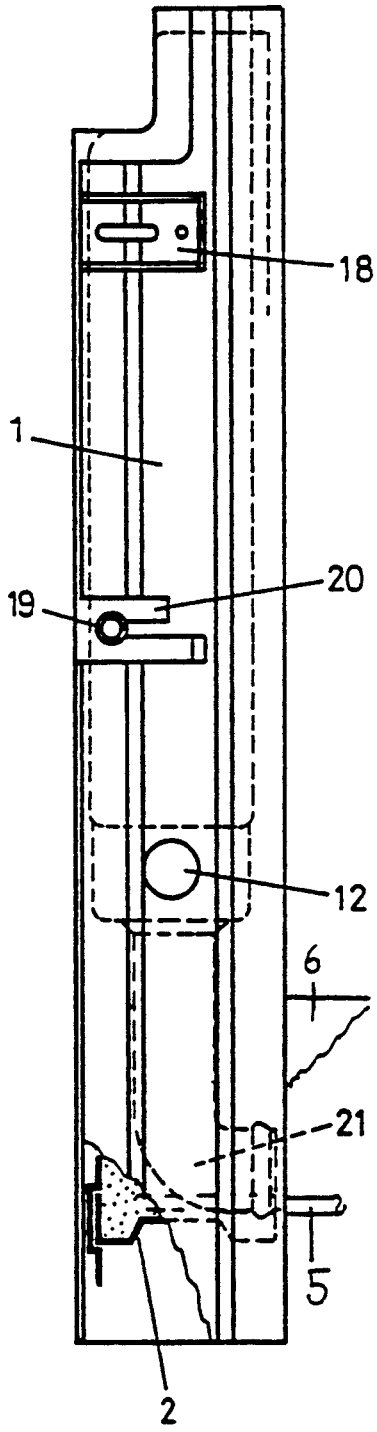
FIG. 3 is a view of a narrow side of the installation block.

The installation block shown in FIG. 1 is a rectangular block with a U-shaped support frame 1, which is filled with a molding 22 made of expanded polystyrene foam. The support frame 1 has two parallel longitudinal side supports 3, as well as a transverse section 2, which are assembled and are held together by the molding 22 in a positive-locking manner.

First elements of the sanitary device such as a concealed flush tank 4 with an inspection opening 4*a*, as well as a flushing elbow 21 with a vent connection 12 mounted on the side for, e.g., an odor exhaust system, is embedded in foam in the molding 22. Lines and fittings (not shown) for supply and discharge from the flush tank 4 are also accommodated here.

The transverse section arranged in the bottom area of the installation block is inserted at its ends into one slot each of a side support 3. The sections 2 and 3 are held together by the molding 22. As is shown in FIG. 1, the side supports 3 have bevels 3*b*, whose edges extend into the molding 22. Indentations 3*a* form mortar joints on the finished installation object and also increase the rigidity of connection of the installation block.

Second sanitary device elements, such as a wall-mounted toilet bowl 6 are arranged on the installation block. The bowl 6 is supported on the installation block with bolts 5, which are fastened on the transverse section 2. The forces acting on the toilet bowl 6 are thus transmitted via the bolts 5 mainly to the transverse section 2 and from this to the side supports 3. To fasten the installation block on a building wall, retaining straps 18 that can be folded out are punched into the side supports 3. If the installation block is suspended in a mounting bracket 20, a fastening screw 19 is screwed into each side support 3. It is also essential here that the forces transmitted from the retaining straps 18 or fastening screws 19 to the installation block are absorbed mainly by the support frame 1.

The density and consequently the hardness of the molding is greater on the surface areas 22' than in the inner areas. This applies especially to the front side of the installation block, which is intended to be covered. Better compression strength properties are achieved due to the greater hardness on the surfaces. Underneath the areas 22', the molding 22 may consequently have relatively low density in order to reduce the overall weight of the installation block, on one hand, and to increase thermal insulation. The molding 22, which surrounds the flush tank 4 practically on all sides, provides thermal protection, which completely replaces condensation insulation inside the flush tank 4.

While a specific embodiment of the invention has been shown and described in detail to illustrate the application of the principles of the invention, it will be understood that the invention may be embodied otherwise without departing from such principles.

What is claimed is:

1. An installation block for a sanitary device, the block comprising:

a support frame surrounding first elements of the sanitary device, said support frame having fastening means for supporting said support frame and fastening second sanitary device elements to said support frame; and an expanded polystyrene molding surrounding said first elements of said sanitary device within said support frame, said expanded polystyrene molding having an outer surface portion which is denser and harder than an inner portion of said expanded polystyrene molding.

2. An installation block according to claim 1, wherein:

said support frame includes a longitudinal support and a transverse section, said longitudinal support and said transverse section including means cooperating with said expanded polystyrene molding to hold said polystyrene molding, said longitudinal support and said transverse section together in a positive-locking manner.

3. An installation block according to claim 1, wherein:

said first elements of said sanitary device include a tank and said expanded polystyrene molding surrounds said tank in order to provide thermal insulation.

4. An installation block according to claim 1, wherein:

said fastening means fastens said support frame to one of a wall and a bracket and said second sanitary device includes a toilet bowl.

5. An installation block for a sanitary device, the block comprising:

a support frame surrounding first elements of the sanitary device, said support frame having fastening means for supporting said support frame and fastening second sanitary device elements to said support frame, said support frame including first and second longitudinal supports connected to a transverse section; and an expanded polystyrene molding surrounding said first elements of said sanitary device within said support frame, said expanded polystyrene molding including a front portion extending between said first and second longitudinal supports, said front portion being denser and harder than an inner portion of said expanded polystyrene molding.

* * * * *